US006445806B1

(12) United States Patent
Jacobson

(10) Patent No.: US 6,445,806 B1
(45) Date of Patent: Sep. 3, 2002

(54) TUNED ELASTIC LOUDSPEAKER ENCLOSURE

(76) Inventor: Michael L. Jacobson, 40032 Thomas Mill Rd., Leesburg, VA (US) 20175

( * ) Notice: Subject to any disclaimer, the term of this patent is extended or adjusted under 35 U.S.C. 154(b) by 0 days.

(21) Appl. No.: 09/500,066

(22) Filed: Feb. 8, 2000

(51) Int. Cl.[7] ..... H04R 25/00

(52) U.S. Cl. ..... 381/345; 381/345; 381/349; 381/386

(58) Field of Search ..... 381/89, 332, 345, 381/346–350, 353–354, 389, 386, 199; 181/153, 156, 171, 198

(56) References Cited

U.S. PATENT DOCUMENTS

| | | | | | |
|---|---|---|---|---|---|
| 3,812,301 | A | | 5/1974 | Lahti | |
| 4,041,446 | A | | 8/1977 | Liebermann | |
| 4,085,289 | A | | 4/1978 | Schmideler | |
| 4,501,934 | A | | 2/1985 | Wiener | |
| 4,580,654 | A | * | 4/1986 | Hale | 181/153 |
| 4,714,133 | A | | 12/1987 | Skaggs, Jr. | |
| 4,720,867 | A | | 1/1988 | Imai et al. | |
| 4,757,548 | A | | 7/1988 | Fenner, Jr. | |
| 4,905,788 | A | * | 3/1990 | Lanternier | |
| 4,961,227 | A | | 10/1990 | Le Donne | |
| 5,150,417 | A | * | 9/1992 | Stahl | 381/154 |
| 5,170,436 | A | | 12/1992 | Powell | |
| 5,333,204 | A | * | 7/1994 | Hamada et al. | |
| 5,335,284 | A | | 8/1994 | Lemons | |
| 5,436,977 | A | * | 7/1995 | Sato | 381/154 |
| 5,473,700 | A | | 12/1995 | Fenner, Jr. | |
| 5,546,469 | A | | 8/1996 | Donahoe | |
| 5,638,456 | A | | 6/1997 | Conley et al. | |
| 5,673,329 | A | | 9/1997 | Wiener | |

* cited by examiner

*Primary Examiner*—Curtis Kuntz
*Assistant Examiner*—P. Dabney
(74) *Attorney, Agent, or Firm*—Whitham, Curtis & Christofferson, P.C.

(57) ABSTRACT

The enclosure of the invention enables greater response in the base range by converting the rear wave present within the enclosure. The enclosure is flexible and is able to act in a manner analogous to a lens in that below a transition frequency, the back wave is reversed to be in phase with the acoustic wave produced by the speaker outside the enclosure and then passed to the listening environment. Above the transition frequency, the enclosure acts as a baffle to dissipates the back wave and acts as a baffle. The result is greater bass response. The speaker system is able to use an under-damped speaker (driver). In this manner, a smaller magnet is used with the speaker (driver) than would otherwise be conventional. The enclosure itself is a simple construction and the result is a low cost speaker system that delivers greater base response.

13 Claims, 4 Drawing Sheets

TUNED ELASTIC LOUDSPEAKER ENCLOSURE

BACKGROUND OF THE INVENTION

The invention relates to a flexible enclosure for a speaker. The enclosure acts on the rear wave emanating from the speaker in two ways simultaneously. Above a "transition frequency" it acts as a baffle to dissipate acoustic energy which would otherwise cancel the front wave. Below the "transition frequency" it acts as a lens to invert the phase of the rear wave and pass it to the listening environment as reinforcement to the front wave. The result is increased bass response.

A speaker driver in open air (with no baffle) produces a front wave, and a rear wave which are 180 degrees out of phase with each other. This is because as the diaphragm of the speaker moves forward to create a compression in front it also makes a rarefaction in back. Similarly when it moves backwards it makes a compression in the rear but a rarifation in the front. In either case the sounds emanating from the front and rear are out of phase.

Without any form of baffle the sound from the rear and the front tend to commingle in the listening environment with detrimental results as they cancel each other.

To prevent this cancellation effect speaker enclosures have been developed which are usually of two types. The sealed enclosure (or infinite baffle) which is designed to prevent the rear wave from entering the listening environment, and the ported (or base reflex) enclosure which, in the best implementations permits the rear wave to enter the listening environment in phase with the front wave.

The Tuned Elastic Enclosure simultaneously acts as both a sealed enclosure above a tuneable "transition frequency" and a well designed ported enclosure below that frequency.

U.S. Pat. No. 3,812,301, issued to Lahti discloses a spherical speaker that has a cone speaker mounted within a spherical flexible sealed enclosure. The speaker diaphragm is loaded by the action of an inverted horn and the action of the enclosed air space behind the enclosure. The flexibility of the enclosure enhances the effects of the loading and it has been found that the current utilization of both loading expedients results in a response from the speaker which extends 25 Hz and an enhanced response in the frequency of 80–300 Hz. The spherical enclosure is made of flexible plastic in the thickness range of 0.040 to 0.090. The disclosed speaker has no baffle effect.

U.S. Pat. No. 5,170,436 to Powell discloses an acoustic speaker having a tuned port in the speaker enclosure. A duct extends through the tuned port into the interior of the cabinet. Reed baffles provided in the enclosure cause the entire cabinet to vibrate in the base range. This allows a small woofer to be used with the cabinet.

It is an object of the invention to provide a speaker system comprising a speaker (driver) and enclosure, that uses the back wave to enhance bass response.

It is another object of the invention to provide a speaker enclosure that uses the back wave below a transition frequency before passing it to the listening environment to enhance bass response and dissipates the back wave above the transition frequency.

It is yet another object of the invention to provide a speaker system that is inexpensive and produces superior sound.

These and other objects of the invention will be evident to one of ordinary skill in the art after reading the following disclosure of the invention.

SUMMARY OF THE INVENTION

The enclosure of the invention enables the speaker (driver) to provide greater response in the bass range by correcting the phase of the low frequency rear wave present within the enclosure, then passing it to the listening environment in correct phase to reinforce the front wave.

Below the transition frequency, the enclosure is flexible and is able to act in a manner analogous to a lens, inverting the phase of the rear wave generated within the enclosure before passing it to the listening environment. Above the transition frequency the enclosure acts as a baffle, dissipating the out of phase mid and high frequency rear wave, not permitting it to enter the listening environment. The result is greater bass response.

With the Tuned Elastic Enclosure, an underdamped speaker cone, driven by a smaller, less expensive magnet can be used, than would otherwise be conventional for similar bass output. The enclosure itself is of simple construction and the result is a low cost speaker that delivers greater bass response.

DETAILED DESCRIPTION OF THE INVENTION

The invention is a tuned elastic speaker enclosure (hereinafter "enclosure" for brevity and clarity) that will be explained in the context of a speaker system that utilizes the enclosure.

Figure 1:
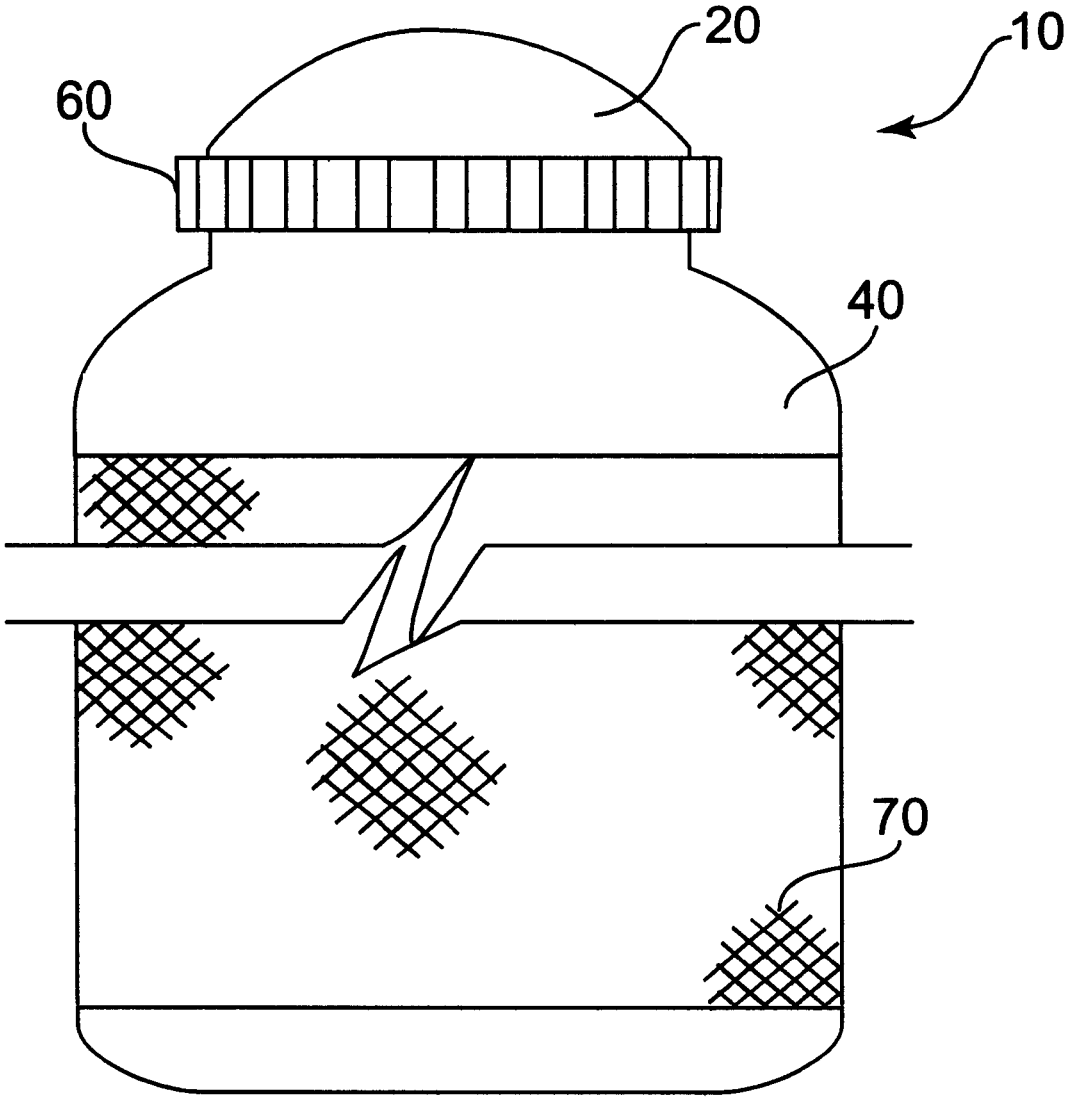
FIG. 1 is a side view of the speaker system.

Referring to FIG. 1, the speaker system 10 of the invention has a speaker (driver) 20 mounted to an enclosure 40. The enclosure is made of flexible, self-supporting material, preferably plastic. The enclosure has a transitional frequency above which the enclosure acts to dissipate the back wave present within the enclosure and below which the enclosure is able to reverse the back wave and pass it to the listening environment so that it is in phase with the front wave created outside the enclosure. The exact frequency of the transitional frequency varies with many factors including the shape, length, and volume of the enclosure and the thickness and type of material that forms the enclosure. By varying these parameters, the transitional frequency can be "tuned". The transitioned frequency can also be altered by changing the design parameters of the speaker (driver). Strictly by way of example and not to be limiting in any way, a speaker system formed in accordance with this invention having an enclosure made from polyvinyl chloride (PVC) had a transitional frequency of 127 Hz.

The best effect occurs when the enclosure has a circular cross-section concentric with the circumference of the speaker (driver) in the direction of the enclosure axis. It has been found that the corners and edges formed by a polygonal cross-section interfere with the back wave's interaction with the enclosure. The speaker (driver) of the device is conventional in that it has a magnet, basket, speaker cone (diaphragm) and is driven by a voice coil within a magnetic field. Preferably, the speaker cone is underdamped at the resonant frequency by using a smaller magnet and/or a wider flux gap than otherwise is conventional.

The structure of the speaker system can best be seen with reference to the drawings. Turning to FIG. 1, the speaker system 10 is clearly shown. The speaker system has an enclosure 40 with an open top and a closed bottom and a cylindrical sidewall having a circular cross-section. Mounted to the open top is a speaker (driver) 20. Securing the speaker (driver) 20 to the enclosure 40 is a collar 60. The dampening effect of the enclosure for frequencies above the transition frequency can be improved by adding a wrap 70 to the enclosure. The wrap 70 can be a plastic mesh material that is adhered to the outside of the enclosure, a visco-elastic spray or can be a label that is adhered to the enclosure by a visco-elastic adhesive. The label provides an easy way to add graphics to the speaker system. If the adhesive has a long polymer chain structure, it enhances the dissipative effect of the enclosure.

Figure 2:
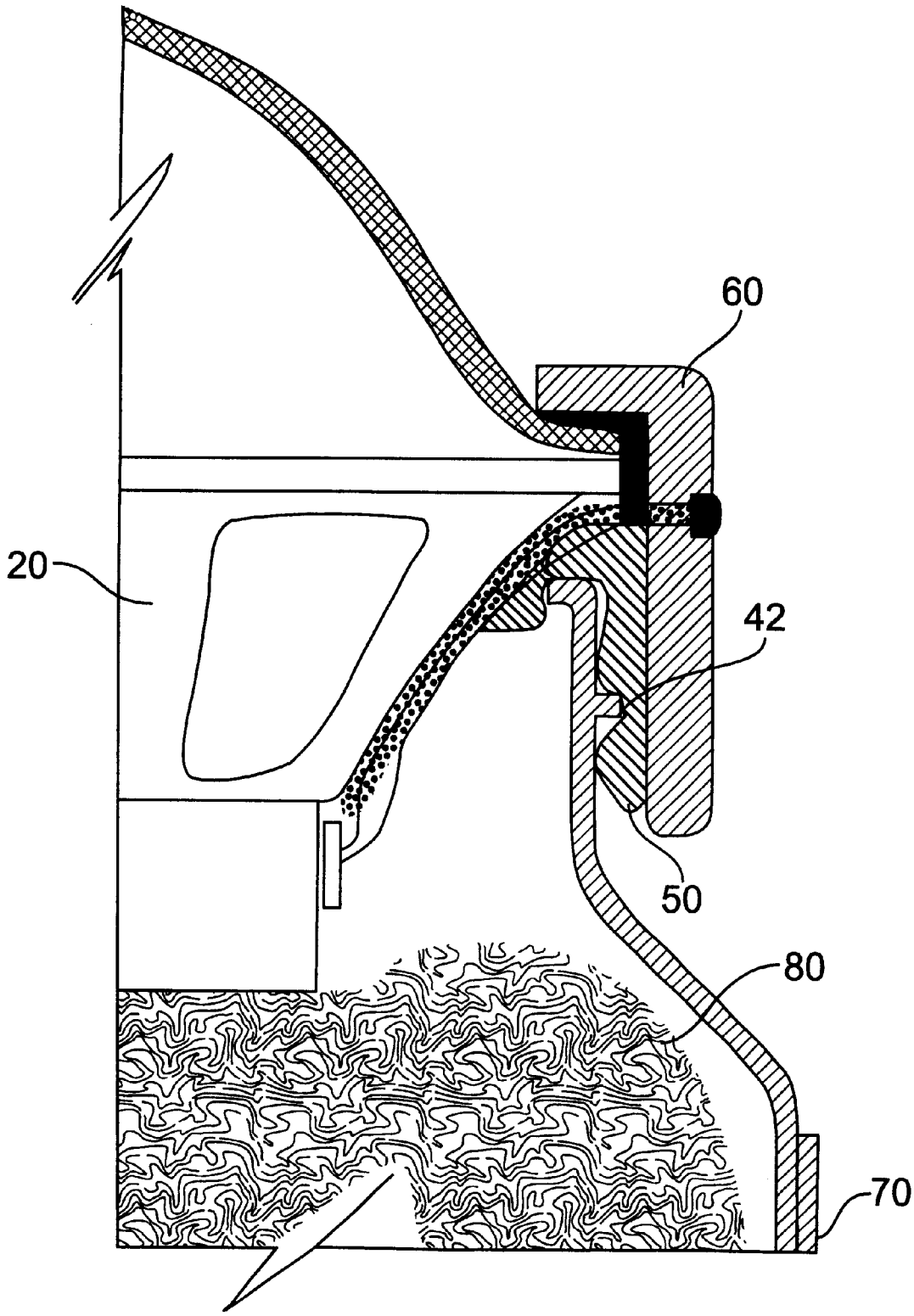
FIG. 2 is a cross-sectional view of the connection between the speaker (driver) and enclosure.

The structure of the speaker (driver) 20 and its connection to the enclosure 40 is best seen in FIG. 2. In all respects, the speaker (driver) is of conventional construction except that it is underdamped at the resonant frequency by using a smaller magnet. This actually reduces the overall cost of the device since speakers with smaller magnets are less expensive.

Diaphragms will vibrate to create acoustical waves. To the extent that the diaphragm's vibrations are transmitted to the speaker basket, it is desirable to isolate the vibrations from the enclosure 40. Wrapping the enclosure opening with an isolator 50 achieves this result and is depicted in FIG. 2. The insulator is preferably a neoprene foam. The speaker (driver) is mounted to the insulation lined opening and secured thereto by a collar 60. The collar has an inwardly extending flange which engages the top of the speaker (driver) and a downwardly extending flange which extends along the top of the enclosure and is in contact with the isolator 50. The inner diameter of the collar 60 is sized so as to compress the isolator between it and the enclosure 40. The isolator 50 can be adhered to the enclosure to retain it in place for ease in installation and integrity of the structure. Also seen in this figure is the fiber filling 80 that is conventional in many speakers.

Figure 3:
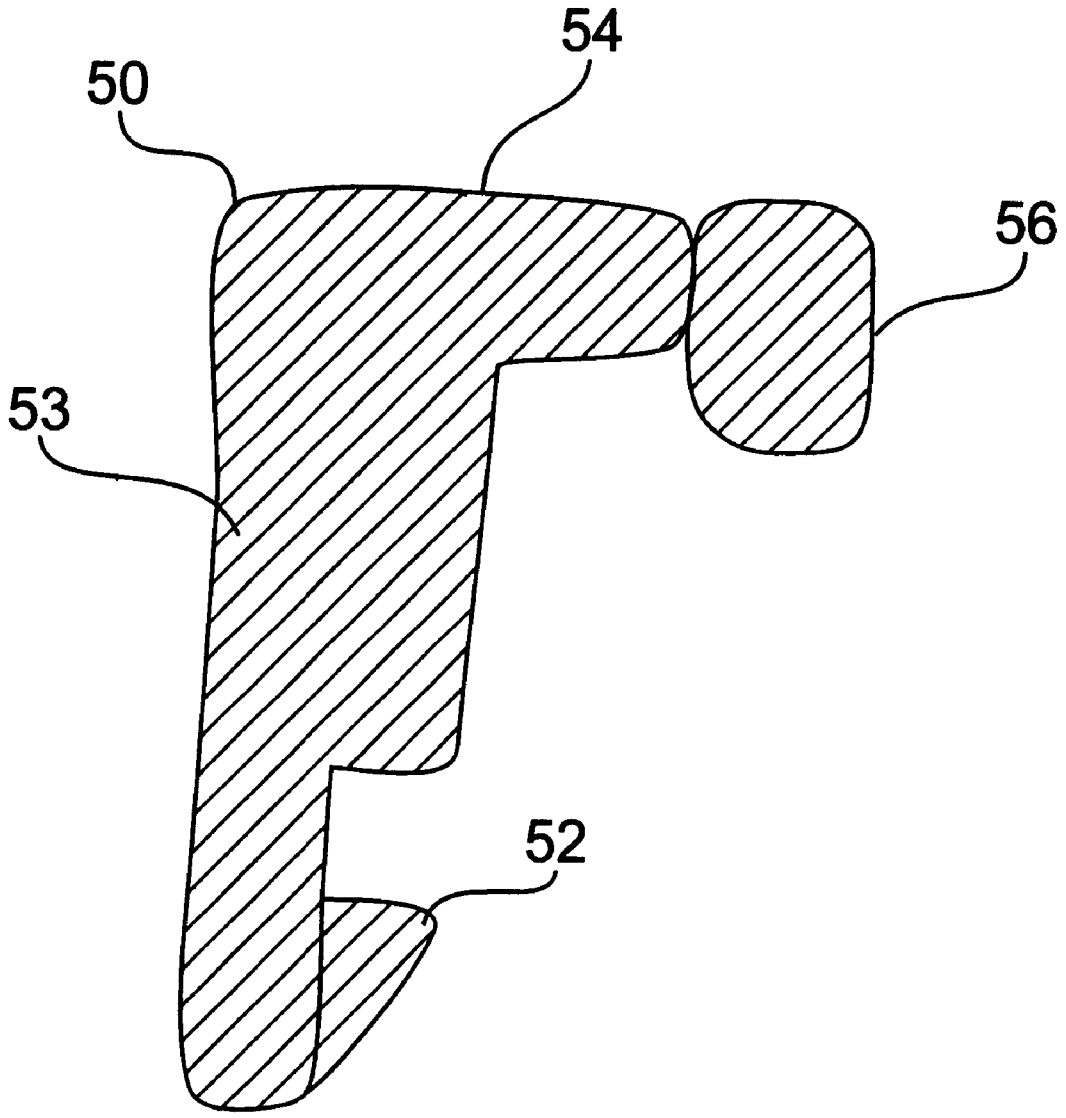
FIG. 3 is a cross-section of the isolator.

The details of the isolator 50 can be seen by the cross-sectional view shown in FIG. 3. A first depending section 53 separates the collar 60 from the enclosure 40. The first depending section 53 has a protrusion 52 that fits underneath a radially projecting rim 42 of the enclosure. The isolator has a radially extending flange 54 and a second depending portion 56. It is the depending portion that separates the speaker (driver) 20 from the enclosure 40.

Figure 4:
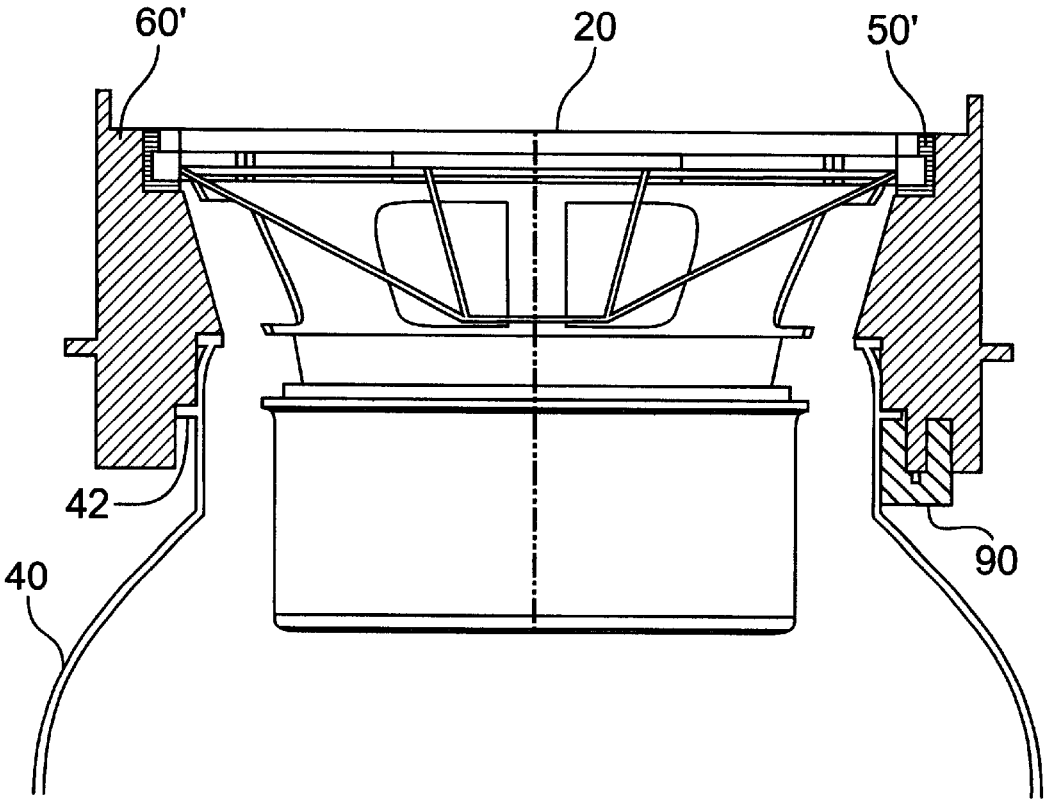
FIG. 4 depicts an alternative method of connecting a speaker (driver) to the enclosure.

FIG. 4 discloses an alternative way to attach a speaker (driver) to the enclosure. Depicted is a PVC enclosure 40 that has the radially-extending rim 42. A polypropylene collar 60' surrounds the top opening and extends above the opening. A lock collar 90 uses the radially-extending rim 42 to connect the collar to the enclosure. A channel is formed in the top of the collar and the speaker (driver) fits within the channel. A isolator 50' isolates any vibrations. Because the collar is made of polypropylene, and polypropylene does not transmit the vibrations, an isolator between the collar 60' and enclosure 40 is not necessary. This allows for a "hard" connection between the collar and enclosure.

While the invention has been described with reference to a preferred embodiment, several variations and modifications would be evident to one of ordinary skill in the art. The invention covers such obvious modifications and is not to be limited by the specific embodiment described but is defined by the appended claims.

What is claimed is:

1. A speaker system, comprising:

an enclosure made from an integral, elastic, self-supporting material and having a single opening for receiving a speaker, a vibration isolator surrounding said single opening in the enclosure, and a speaker mounted within said single opening on the vibration isolator and sealing the enclosure, the speaker producing a back wave within the sealed enclosure and a front wave outside the sealed enclosure, said enclosure dissipating the back wave above a transitional frequency and inverting a phase of the back wave below the transitional frequency so as to be in phase with the front wave and reinforcing the front wave in a listening environment.

2. The speaker system of claim 1, wherein said enclosure is made of plastic.

3. The speaker system of claim 1, wherein said enclosure has a circular cross-section.

4. The speaker system of claim 1, further comprising a wrap on said enclosure.

5. The speaker system of claim 4, wherein said wrap is a lable with a visco-elastic adhevise.

6. The speaker system of claim 1, wherein said vibration isolator is neoprene foam.

7. The speaker system of claim 1, further comprising a wrap on said enclosure.

8. The speaker system of claim 7, wherein said wrap is a label with a visco-elastic adhesive.

9. The speaker system of claim 1, wherein said single opening in the enclosure is defined by a generally cylindrical, outwardly projecting flange and said vibration isolator comprises:

a generally cylindrical portion surrounding the flange defining the single opening of the enclosure and having an inside diameter approximately equal to an outside diameter of the flange, and an integral, radially projecting portion overlying an exposed circular edge of the flange, the speaker being mounted on the radially projecting portion of the vibration isolator.

10. The speaker system of claim 9, wherein the generally cylindrical, outwardly projecting flange has a radially, outwardly projecting rim and the generally cylindrical portion of the vibration isolator has an inwardly projecting protrusion which engages the rim.

11. The speaker system of claim 10, further comprising a generally cylindrical collar having an inner diameter approximately equal to an outer diameter of the generally cylindrical portion of the vibration isolator, the collar retaining the speaker on the radially projecting portion of the vibration isolator and compressing the generally cylindrical portion of the vibration isolator against the outwardly projecting flange defining the single opening in the enclosure.

12. The speaker system of claim 1, wherein said single opening in the enclosure is defined by a generally cylindrical, outwardly projecting flange, further comprising a collar surrounding the flange and projecting beyond the flange, the collar having a radial recess for receiving the vibration isolator and within which the speaker is mounted.

13. The speaker system of claim 1, wherein the speaker comprises a cone, a basket supporting the cone, and a magnet driving the cone, the cone being underdamped at a resonant frequency.

* * * * *